United States Patent [19]

Thomas et al.

[11] 4,092,764

[45] June 6, 1978

[54] CLEANING OF TEXTILE CARDING MACHINES INCLUDING AN AIR RECIRCULATING SYSTEM

[75] Inventors: Arthur E. Thomas; E. Alan Pace, both of Winston-Salem, N.C.

[73] Assignee: Envirotech Corporation, Menlo Park, Calif.

[21] Appl. No.: 747,138

[22] Filed: Dec. 3, 1976

[51] Int. Cl.[2] ..... D01G 15/76

[52] U.S. Cl. ..... 19/107; 55/385 R

[58] Field of Search ..... 19/107; 55/361, 381, 55/385 R

[56] References Cited

U.S. PATENT DOCUMENTS

| | | | |
|---|---|---|---|
| 1,666,379 | 4/1928 | Hartley | 19/107 |
| 3,150,415 | 9/1964 | Reiterer | 19/107 |
| 3,376,610 | 4/1968 | Williams | 19/107 |
| 3,486,309 | 12/1969 | Wild | 19/107 X |
| 3,678,538 | 7/1972 | Sloan | 19/107 |
| 3,877,903 | 4/1975 | Peterson | 55/381 |
| 3,987,517 | 10/1976 | Bonalumi | 19/107 |

FOREIGN PATENT DOCUMENTS

| | | | |
|---|---|---|---|
| 363,914 | 9/1962 | Switzerland | 19/107 |
| 474,578 | 8/1969 | Switzerland. | |
| 1,019,768 | 2/1966 | United Kingdom | 19/107 |
| 1,148,518 | 4/1969 | United Kingdom | 19/107 |
| 1,138,220 | 12/1968 | United Kingdom | 19/107 |
| 856,821 | 12/1960 | United Kingdom | 19/107 |

*Primary Examiner*—Mervin Stein
*Assistant Examiner*—Andrew M. Falik
*Attorney, Agent, or Firm*—William S. Bernheim; Robert E. Krebs

[57] ABSTRACT

A manifold apparatus is provided in the bottom region of a carding machine for pneumatically transporting waste and trash to one side of the carding machine for capture and further includes an air recirculating system individual to the carding machine for use in conjunction with the bottom manifold.

23 Claims, 7 Drawing Figures

CLEANING OF TEXTILE CARDING MACHINES INCLUDING AN AIR RECIRCULATING SYSTEM

BACKGROUND OF THE INVENTION

The present invention relates to pneumatic cleaning of carding machines, and more particularly to a manifold apparatus for the bottom region of a carding machine.

The escape of waste and trash from a carding machine can be classified as exterior and interior. The major exterior escape locations are the so-called lickerin region and the so-called doffer region. The major interior escape location is the space enclosed by the chassis of the carding machine and will be referred to as the bottom region.

Examples of the pneumatic cleaning equipment for use adjacent the lickerin region of the carding machine are illustrated in U.S. Pat. Nos. 3,315,320, 3,707,020 and 3,678,538. Examples of pneumatic cleaning equipment for use adjacent the doffer region of the carding machine are illustrated in U.S. Pat. Nos. 3,604,061, 3,387,337 and 3,357,062.

A common problem with the bottom region is the need for additional manual cleaning on a regular basis. U.S. Pat. Nos. 3,150,415 and 3,943,596 each teach pneumatic cleaning equipment for moving the waste to be removed from the bottom region in the end to end direction of the carding machine.

OBJECTS OF THE INVENTION

Accordingly, it is an object of the present invention to provide a new pneumatic manifold apparatus for the bottom region of carding machines which makes regular manual cleaning of the bottom region unnecessary.

Another object is to provide a bottom manifold apparatus for moving the waste and trash from one side to the other side for collection. Yet another object of the invention is to provide each carding machine having a new bottom manifold apparatus, an air recirculating system individual to that machine to allow a low pressure, free air, central air filter system to be used for the carding room.

BRIEF DESCRIPTION OF THE FIGURES

Further objects and advantages of the invention will be apparent from the following detailed description, taken in conjunction with the accompanying drawings illustrating preferred embodiments of the invention.

In the drawings, which are schematic in order to illustrate the essence of the invention.

DETAILED DESCRIPTION OF A PREFERRED EMBODIMENT

Figure 1:
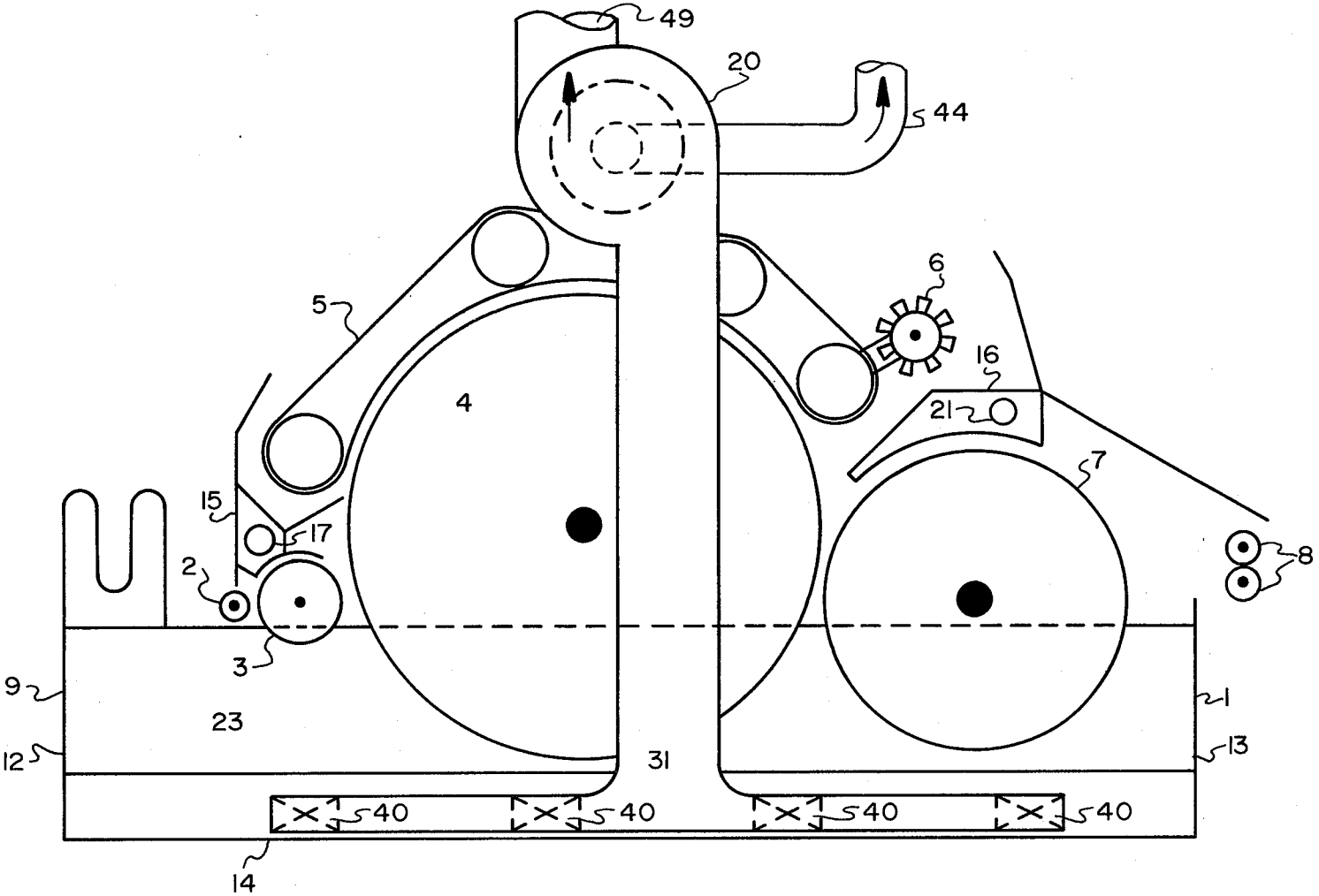
FIG. 1 is a side elevation view of a carding machine with a pneumatic cleaning system according to the present invention.

In FIG. 1 a carding machine 1 of the usual type comprises a feed roll 2 arranged to deliver a lap of fibrous material to a lickerin 3 which, in turn, carries the material to a main card cylinder or swift 4. Mounted above the swift and adjacent to its surface is a chain 5 of carding flats which are arranged to align the fibers in the material carried by the swift. A brush 6 is mounted to contact and brush the flat chain 5. A doffer 7 removes the fibrous material as a web from the swift and delivers it to a pair of calender rolls 8 at the front of the carding machine 1. Inasmuch as the structure and operation of the above mentioned components of the carding machine are well known, they are not described in further detail.

Figure 2:
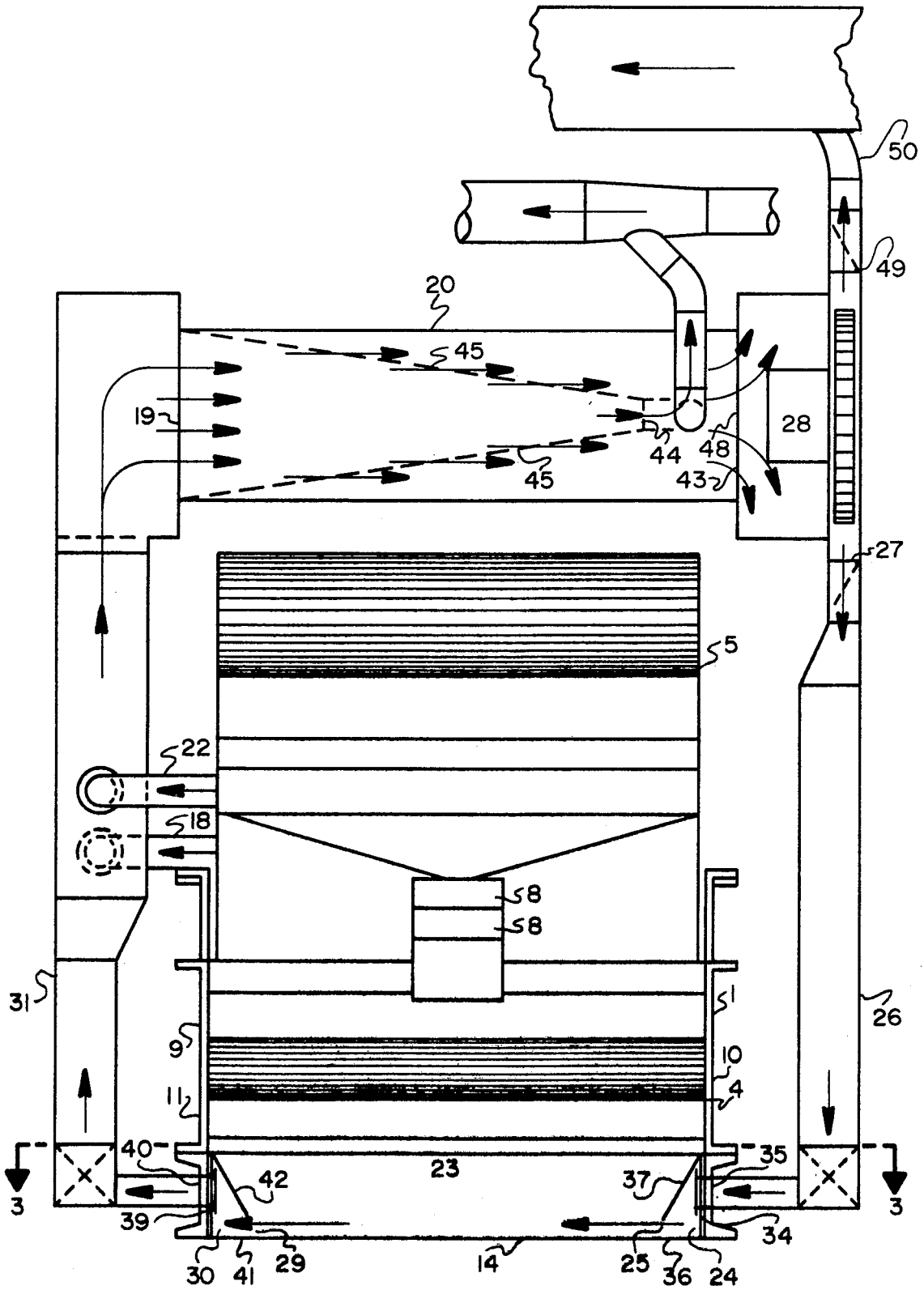
FIG. 2 is an end view of the carding machine of FIG. 1.

Mounted on the carding machine to pneumatically clear waste and trash from the lickerin region and from the doffer region are suction plenums 15 and 16, respectively, each having a slot orifice extending from side to side across the carding machine. Suction is applied to the lickerin plenum 15 by connecting to an aperture 17 in the plenum a suction duct 18 in communication with an inlet 19 of a waste concentrator 20 as shown in FIG. 2. Suction is applied to the doffer plenum 16 by connecting to an aperture 21 in the plenum a suction duct 22 in communication with the inlet 19. The structure and operation of the doffer and lickerin plenum means are also well known and for that reason need not be described in further detail.

The carding machine 1 is supported by a chassis housing 9 resting on the floor 14 of the carding room in which the machine is used. Mounted to the chassis housing 9 below the carding machine proper to define an enclosure 23 are side walls 10 and 11, and end walls 12 and 13. The enclosure 23 defines a bottom region beneath the carding components into which particles of waste and trash from the carding components fall and collect.

Figure 3:
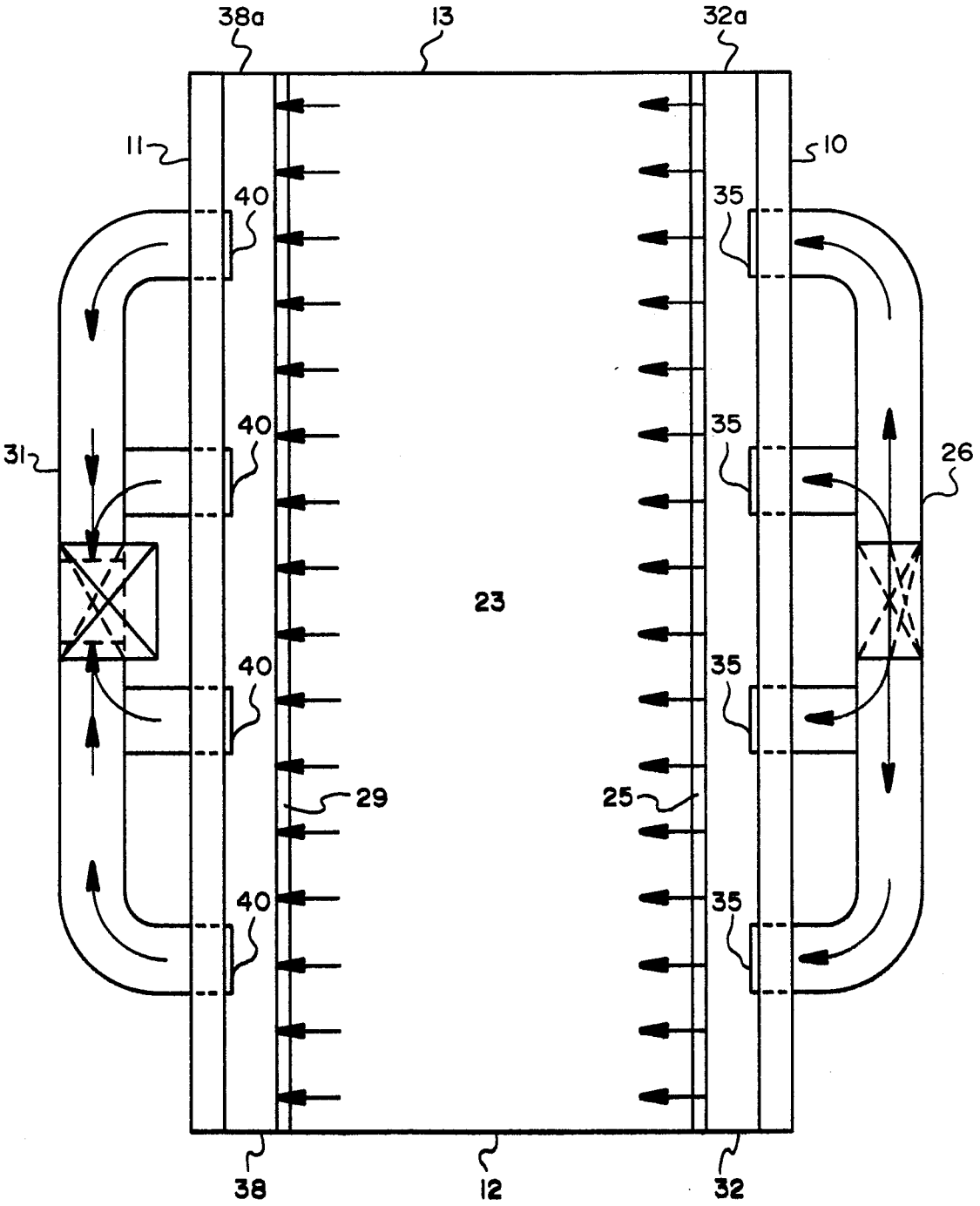
FIG. 3 is a horizontal section view taken along line 3—3 of FIG. 2.

Referring now to FIGS. 2 and 3 generally, to pneumatically clear waste and trash from the enclosure 23, a pressure plenum 24 is formed to have an orifice 25 extending along one side 10 of the housing 9. Air is provided to the pressure plenum 24 through a duct 26 from a recycle outlet 27 of a directional splitting fan 28. The pressurized air is emitted through the orifice 25 into the bottom region from the pressure plenum 24 to transport waste and trash toward a suction orifice 29 located opposite to receive the emitted air. A suction plenum 30 is formed to have the orifice 29 extend along the opposite side 11 of the housing 9. Air is drawn by negative pressure from the suction plenum 30 through a duct 31 to the inlet 19 of the waste concentrator 20. The drawing of air from the plenum 30 in turn draws air, waste and trash from the bottom region 23 through orifice 29. The two plenums 24 and 30 can be of identical configuration and by reversing the duct, interchange in function.

The pressure plenum 24 is preferably a triangular cross sectional plenum chamber located within the bottom region 23 along and extending the length of the side wall 10 of the carding machine at the floor 14. The orifice 25 is a horizontally opened slot close to the side wall 10 and extending from end wall 12 to end wall 13.

Referring more particularly to the details of the construction, the pressure plenum 24 includes a pair of generally triangular side plates 32 and 32a of similar profile and construction for use as right and left plenum sides. A vertical panel 34 of generally planar rectangular configuration is attached to the side plates. The vertical panel 34 has an aperture therethrough, preferably a plurality of apertures 35 to which the duct 26 is attached. A horizontal panel 36 of generally planar rectangular configuration is attached to bottom edges of the side plates. An inclined panel 37 of generally planar rectangular configuration is attached to the side plates to contact along one panel edge with the vertical panel 34 and to define the orifice 25 between its opposite panel edge and the horizontal panel 36. The angle of the inclined panel 37 should be sufficient to cause waste alighting thereon to slip and fall to the floor 14.

Figure 4:
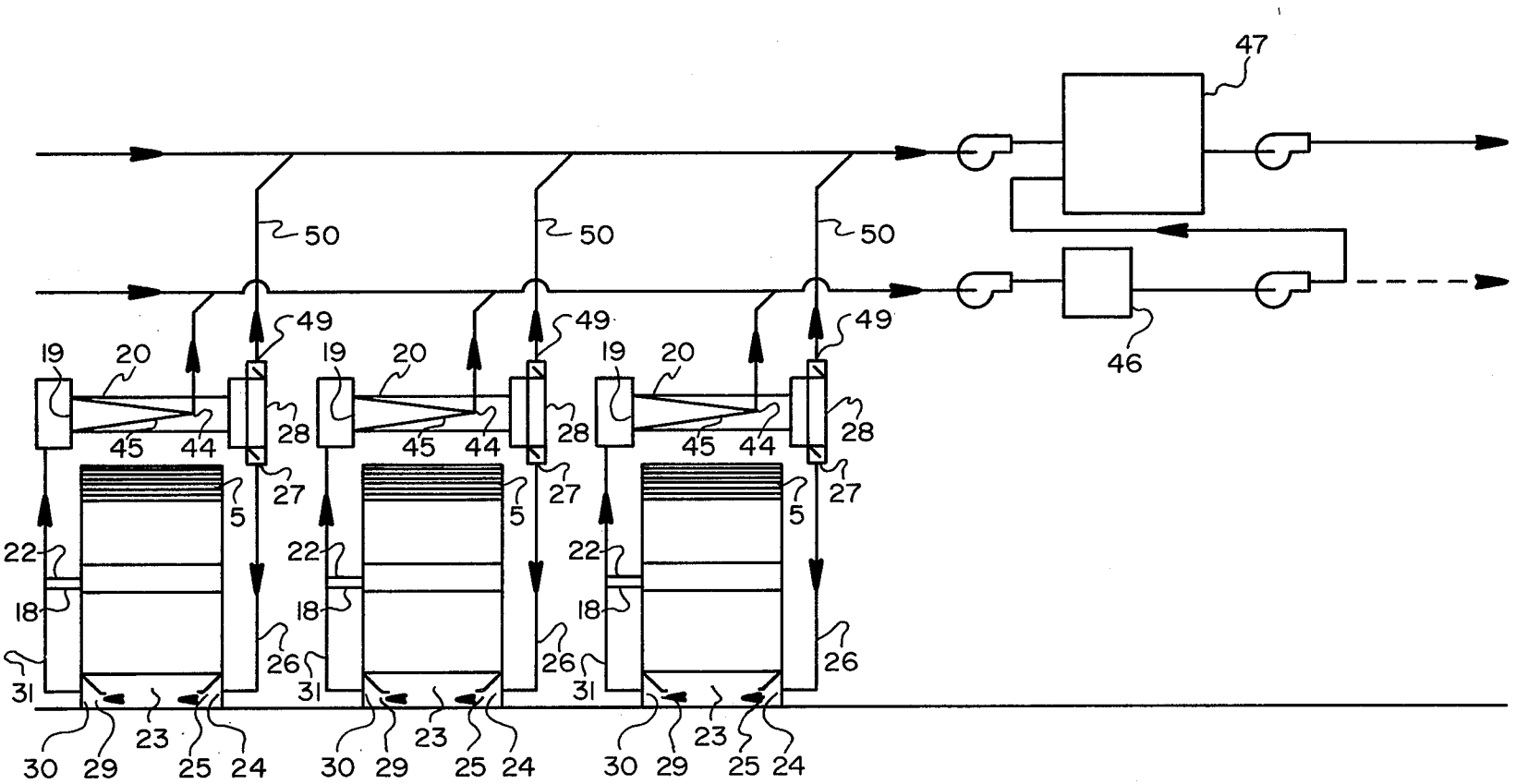
FIG. 4 is a schematic diagram of a recirculating system for an individual carding machine and overall system for a plurality of carding machines according to the present invention.

As shown in FIGS. 1, 2 and 4 the carding machine is preferably elevated a substantial distance above the carding room floor by mounting the carding machine on a walled rectangular frame of about 2 to 14 inches in height. The additional height provides a large unobstructed space beneath the carding machine 1 as part of the bottom region 23 in which to position the pressure plenum 24 and the suction plenum 30. The added clearance between the carding components and the floor 14 lessens any turbulence about the carding components as air flows from orifice 25 to orifice 29.

Figure 7:
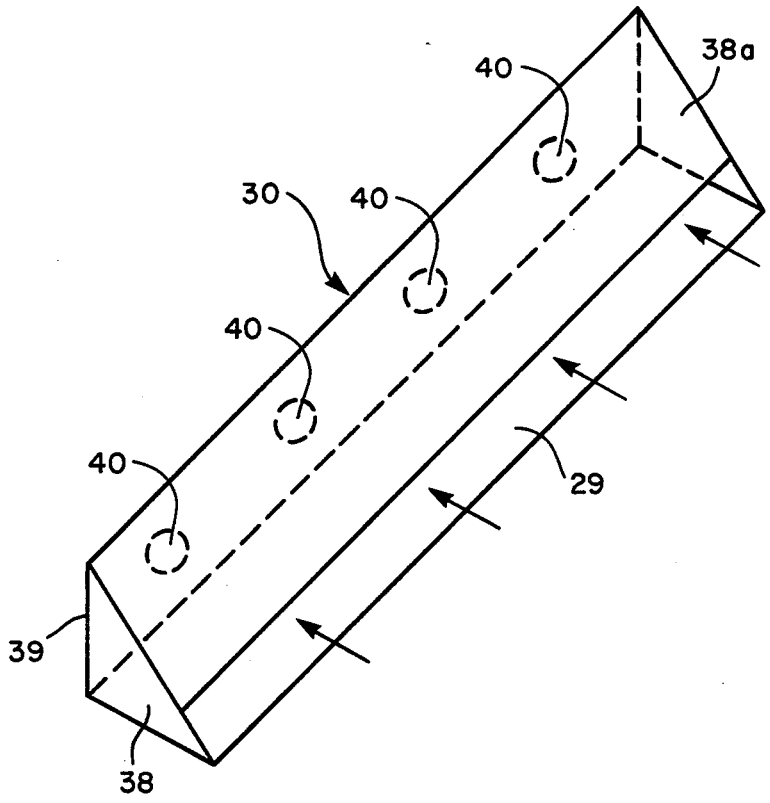
FIG. 7 is a perspective view of the suction plenum 30 shown in FIG. 3.

The suction plenum 30, as shown in FIG. 7, is preferably a triangular cross-sectional plenum chamber located within the bottom region along and extending the length of the other side wall 11 of the carding machine at the floor 14. The orifice 29 is a horizontally opened slot close to side wall 11, opposite and spaced from orifice 25 and extending from end wall 12 to end wall 13.

Referring more particularly to the details of construction, the suction plenum 30 includes a pair of generally triangular side plates 38 and **38*a* of similar profile and construction for use as right and left plenum sides. A vertical panel 39 of generally planar rectangular configuration is attached to the side plates. The vertical panel has an aperture therethrough, preferably a plurality of apertures 40 to which the duct 31 is attached. A horizontal panel 41 of generally planar rectangular configuration is attached to bottom edges of the side panels 38 and 38*a*. An inclined panel 42 of generally planar rectangular configuration is attached to the side plates to contact along one panel edge with the vertical panel 39 and to define the orifice 29 between its opposite panel edge and the horizontal panel 41. The angle of the inclined panel 42 should be sufficient to cause waste aligning thereon to slip and fall to the floor 14**.

As shown in the Figures the plenums 24 and 30 can be integrated with the carding machine chassis 9 with, respectively, the side walls 10 and 11 serving as the vertical panels 39, the floor 14 serving as the horizontal panels 36 and 41 and the end walls 12 and 13 serving as the side plates 32, **32*a*, 38 and 38*a* with the triangular shape being defined by the attachment of inclined panels 37 and 42**.

Although the pressure plenum 24 and suction plenum 30 are illustrated and described in the foregoing as each comprising a single unit, alternatively they could each comprise a plurality of plenums. Multiple plenums can be used where there are clearance or obstruction problems and to control the air flow distribution. For the same reason a plurality of orifices 25 or 29 can be utilized to advantage.

In the preferred embodiment, the waste concentrator 20 is a conical condenser having a cylindrical housing having the air inlet 19 at one end, an air outlet 43 at its opposite end and a waste discharge outlet 44. The air inlet is attached to ducts 18, 22 and 31 to admit air entraining waste and trash. The air outlet 43 discharges a large portion, approximately 90% of the air, cleared of entrained waste and trash. The waste outlet 44 is positioned intermediate the inlet 19 and air outlet 43, and is of a substantially reduced cross-sectional area as compared to the inlet 19. The waste outlet 44 discharges a small portion of the air, approximately 10%, with the waste and trash concentrated therein.

The inlet 19 and the waste outlet 44 are interconnected by a gradually tapering foraminous frusto-conical wall 45 of woven nylon mesh, or like material, which clears the air passing therethrough to the air outlet 43 of waste and trash but not dust. The condenser 20 handles the initial large volumes of air required for continuous waste and trash transport across floor 14 and effects the desired waste and trash concentrating to within the capacity of a conventional waste-separating apparatus 46 which is connected to the waste outlet 44.

The waste-separating apparatus 46 separates waste and trash from the air stream. The air discharged from the waste-separating apparatus 46 can be discharged to a conventional central air filter 47 for dust removal or to the atmosphere.

The cleared air from air outlet 43 is fed to an inlet 48 of the fan 28. The fan 28 can be axial or preferably centrifugal and has two outlets 49 and 27. The first bleed outlet 49 connects by duct 50 to the central air filter 47. The second recycle outlet 27 recirculates air to the pressure plenum 24 through duct 26.

As mentioned previously, the suction plenum 30 can include a plurality of plenums. Each of these plenums can be connected to separate waste concentrators 20 to allow segregation of the waste and trash from different areas of the bottom region 23.

Since the waste is separated from the air at each waste concentrator 20, the duct 50 connecting the bleed outlet 49 with the central air filter 47 transports cleaned air and, therefore, can handle air from all cards regardless of the fiber being processed.

In a typical operation cotton fiber for processing is fed to the carding machine and is passed in turn from the feed roll 2 to the lickerin 3, to the main cylinder 4, to the doffer 7 and to the calender rolls 8. During the fiber's passage through the machine, waste and trash escape to the atmosphere in the lickerin region and the doffer region and fall to the floor 14 in the bottom region from the carding components.

As an example to capture this waste and trash approximately 1500 cfm is drawn through inlet 19 of the waste concentrator 20. Approximately 760 cfm is drawn from the bottom suction plenum 30 and a combined 740 cfm is drawn from the lickerin 15 and doffer 16 plenums. The drawing of air captures waste and trash about the orifices of the plenums and transports the waste and trash to the waste concentrator 20.

In the waste concentrator 20, 1350 cfm is cleared of waste and trash by passage through the foraminous wall 45. The 1350 cfm is emitted through the air outlet 43 and passed to the fan 28 which provides the majority of the power needed to circulate the air. The remaining 150 cfm carrying the now concentrated trash and waste is emitted through the waste outlet 44 and passes to the waste-separating apparatus 46.

The fan 28 splits the 1350 cfm between its two outlets. The bleed outlet 49 delivers 740 cfm to the central air filter 47 for dust removal. The recycle outlet 27 delivers 610 cfm to the pressure plenum 24. From the pressure plenum 24 the 610 cfm is emitted through orifice 25 horizontally across the bottom region and transports waste and trash falling to floor 14 toward orifice 29 for capture.

The 150 cfm difference between the 610 cfm emitted by orifice 25 and the 760 cfm suctioned by orifice 27 is drawn from the bottom region 23 through holes provided in the chassis housing 9 to admit room air.

A side-to-side air flow velocity of about 80–160 ft/min. and preferably about 120 ft/min. is satisfactory to transport waste and trash across floor 14 from orifice 25 to orifice 29 without interfering with the carding process. If large amounts of dirt are present in the bottom region 23, flow velocities of up to 250 ft/min can be necessary.

Figure 5:
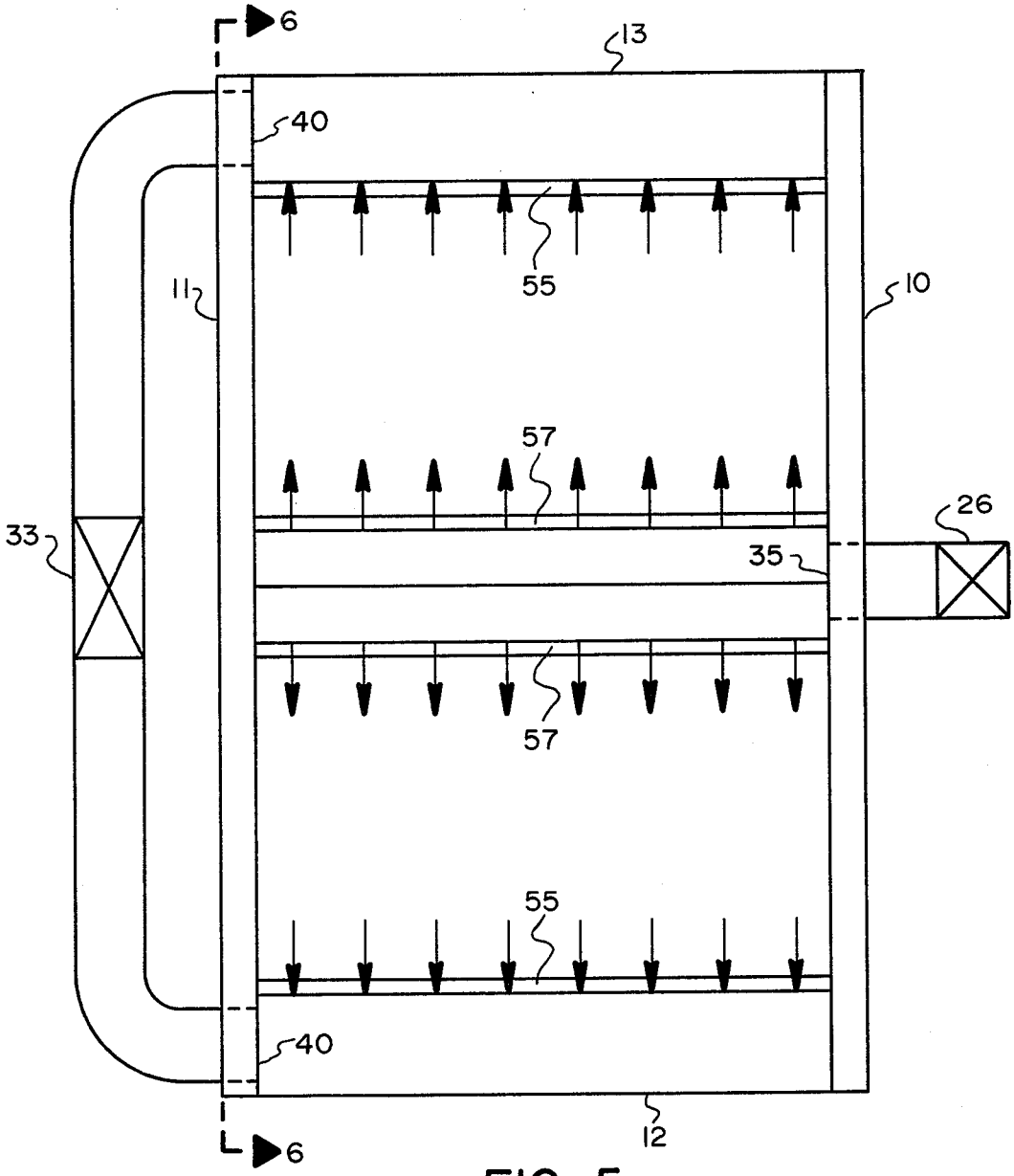
FIG. 5 is a horizontal section view of the bottom region 23 showing a alternative bottom plenum configuration according to the present invention.
Figure 6:
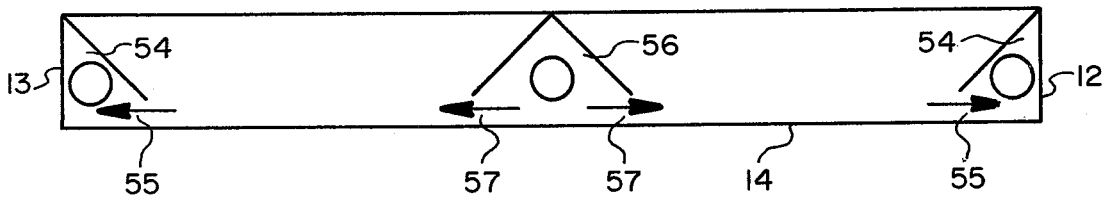
FIG. 6 is a side view of the horizontal section of FIG. 5 along line 6—6.

An alternative bottom plenum configuration is shown in FIGS. 5 and 6 which has no plenums along side walls 10 and 11. Instead, in the bottom region triangular suction plenums 54 are positioned along each of the end walls 12 and 13 with orifices 55 extending from side to side to suction air from the bottom region. Spaced from both ends and preferably beneath the main cylinder 4 is a pressure plenum 56 having two orifices 57 extending from side to side, one opposite each of the suction orifices 55. The orifices 57 of the pressure plenum emit air toward and to be received by their respective orifices 55 of the suction plenums.

We claim:

1. An apparatus for removing waste and trash from a carding machine including a supporting chassis set upon a carding room floor, the chassis having side walls which are parallel to the flow of fiber through the machine and end walls to define an enclosed bottom region in the machine beneath the carding components, comprising:

a. a first means attached to the machine to provide a flow of cleared air under positive pressure into the bottom region;

b. a pressure plenum mounted to the machine, said pressure plenum connected in communication with said first means to receive the flow of air under positive pressure and having an emitting orifice to emit the pressurized air into the bottom region;

c. a second means mounted to the machine to draw under negative pressure a flow of air entraining waste and trash from the bottom region;

d. a suction plenum connected to said second means, mounted to the machine and having a receiving orifice formed spaced from and opposite the emitting orifice through which is drawn a flow from the emitting orifice after the flow has crossed the floor and entrained waste and trash;

e. a waste concentrating means mounted to receive a flow from said suction plenum and separate this flow between a large volumetric flow of air clear of entrained waste and trash and a small volumetric flow of air in which the waste and trash is concentrated; and f. a recirculating means delivering a part of the large portion of air to said first means so that this air is recirculated as a component of the flow provided by said first means.

2. The apparatus of claim 1 further including a separate means connected to the base of the chassis to elevate the machine a substantial distance above the carding room floor.

3. The apparatus of claim 1 wherein the carding machine chassis is mounted on a walled rectangular frame which is 2 to 14 inches in height and wherein said pressure plenum and said suction plenum are mounted inside said rectangular frame.

4. The apparatus of claim 1 wherein said recirculating means includes a centrifugal fan having an inlet for admitting air and two outlets for splitting the admitted air into two portions with one outlet being connected to said pressure plenum.

5. The apparatus of claim 1 wherein said pressure plenum extends from side wall to side wall and emits said first flow in the end to end direction and wherein said suction plenum extends from side wall to side wall.

6. The apparatus of claim 1 further including a lickerin plenum mounted in the lickerin region and a doffer plenum mounted in the doffer region, both plenums having an orifice to capture waste and trash in their respective regions and being in flow communication with said waste concentrating means.

7. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first means attached to the machine to provide a flow of cleared air under positive pressure into the bottom region;

b. a pressure plenum mounted along a first side wall of the chassis, said pressure plenum connected in communication with said first means to receive the flow of air under positive pressure and having an emitting orifice to emit the pressurized air into the bottom region;

c. a second means attached to the machine to draw under negative pressure a flow of air containing entrained waste and trash from the bottom region;

d. a suction plenum connected to said second means, mounted to the chassis along the side opposite to said first side wall and having a receiving orifice formed spaced from and opposite the emitting orifice through which is drawn a flow from the emitting orifice after the flow has crossed the floor and entrained waste and trash; and e. a waste concentrating means mounted to receive a flow from said suction plenum and separate this flow between a large volumetric flow of air clear of entrained waste and trash and a small volumetric flow of air in which the waste and trash is concentrated.

8. The apparatus of claim 7 further including a separate means connected to the base of the chassis to elevate the machine a substantial distance above the carding room floor.

9. The apparatus of claim 8 wherein said separate means includes a walled rectangular frame which is 2 to 14 inches in height.

10. The apparatus of claim 7 further including a plenum having an orifice to capture waste and trash in the doffer region and a plenum having an orifice to capture waste and trash about the lickerin region, said doffer plenum and lickerin plenum being in flow communication with said first means.

11. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first means attached to the machine to provide a flow of cleared air under positive pressure into the bottom region;

b. a pressure plenum mounted to extend along the length of a first side of the chassis, said pressure plenum connected in communication with said first means to receive the flow of air under positive pressure, having an emitting orifice to emit the pressurized air into the bottom region, having a triangular cross-section and including a pair of triangular side plates of similar profile for use as right and left plenum sides, a vertical panel of planar rectangular configuration which is attached to the side plates, a horizontal panel of planar rectangular configuration which is attached to the side plates to contact along one panel edge with the vertical panel and to define the emitting orifice to extend from end wall to end wall between its opposite panel edge and the horizontal panel;

c. a second means attached to the machine to draw under negative pressure a flow of air containing entrained waste and trash from the bottom region;

d. a suction plenum connected to said second means, mounted to the chassis along the side opposite to said first side wall and having a receiving orifice formed spaced from and opposite the emitting orifice through which is drawn a flow from the emitting orifice after the flow has crossed the floor and entrained waste and trash; and e. a waste concentrating means mounted to receive a flow from said suction plenum and separate this flow between a large volumetric flow of air clear of entrained waste and trash and a small volumetric flow of air in which the waste and trash is concentrated.

12. The apparatus of claim 11 wherein said suction plenum extends the length of the side wall, is triangular in cross-section and includes a pair of triangular side plates of similar profile for use as right and left plenum sides, a vertical panel of planar rectangular configuration which is attached to the side plates, a horizontal panel of planar rectangular configuration which is attached to the bottom edges of the side plates and an inclined panel of planar rectangular configuration which is attached to the side plates to contact along one panel edge with the vertical panel and to define the receiving orifice between its opposite panel edge and the horizontal panel.

13. The apparatus of claim 12 wherein said vertical panel of said pressure plenum has an aperture therethrough by which said first means is in communication with said pressure plenum and wherein said vertical panel of said suction plenum has an aperture therethrough by which said second means is in communication with said suction plenum.

14. An apparatus for removing waste and trash from a carding machine including a supporting chassis set upon a carding room floor, the chassis having side walls which are parallel to the flow of the fiber through the machine and end walls to define an enclosed bottom region in the machine beneath the carding components, comprising:

a. a separate means connected to the base of the chassis to elevate the machine a substantial distance above the carding room floor;

b. a first means attached to the machine to provide a flow of cleared air under positive pressure into the bottom region;

c. a pressure plenum mounted to the machine to extend along a substantial portion of one of the side walls said pressure plenum connected in communication with said first means to receive the flow of air under positive pressure and having an emitting orifice to emit the pressurized air into the bottom region in primarily the side to side direction;

d. a second means mounted to the machine to draw under negative pressure a flow of air containing entrained waste and trash from the bottom region; and e. a suction plenum connected to said second means, mounted to the machine and having a receiving orifice formed spaced from and opposite the emitting orifice through which is drawn a flow from the emitting orifice after the flow has crossed the floor and entrained waste and trash.

15. The apparatus of claim 14 wherein said separate means includes a walled rectangular frame which is 2 to 14 inches in height.

16. The apparatus of claim 15 wherein said pressure plenum and said suction plenum are mounted within said walled rectangular frame.

17. An apparatus for removing waste and trash from a carding machine including a supporting chassis set upon a carding room floor, the chassis having side walls which are parallel to the flow of fiber through the machine and end walls to define an enclosed bottom region in the machine beneath the carding components, comprising:

a. a first means attached to the machine to provide a flow of cleared air under positive pressure into the bottom region;

b. a pressure plenum mounted within the chassis to extend along the length of a first side wall from end wall to end wall, said pressure plenum connected in communication with said first means to receive the flow of air under positive pressure, having an emitting orifice to emit the pressurized air into the bottom region, having a triangular cross-section and including a pair of triangular side plates of similar profile for use as right and left plenum sides, a vertical panel of planar rectangular configuration which is attached to said side plates, a horizontal panel of planar rectangular configuration which is attached to the bottom edges of said side plates and an inclined panel of planar rectangular configuration which is attached to said side plates to contact along one panel edge with the vertical panel and define the emitting orifice to extend from end wall to end wall between its opposite panel edge and the horizontal panel;

c. a second means mounted to the machine to draw under negative pressure a flow of air entraining waste and trash from the bottom region;

d. a suction plenum connected to said second means, mounted along the opposite side wall of the chassis and having a receiving orifice extending from end wall to end wall formed spaced from and opposite the emitting orifice through which is drawn a flow from the emitting orifice after the flow has crossed the floor and entrained waste and trash;

e. a waste concentrating means mounted to receive a flow from said suction plenum and separate this flow between a large volumetric flow of air clear of entrained waste and trash and a small volumetric flow of air in which the waste and trash is concentrated; and f. a recirculating means delivering a part of the large portion of air to said first means so that this air is recirculated as a component of the flow provided by said first means.

18. An apparatus for removing waste and trash from a carding machine including a supporting chassis set upon a carding room floor, the chassis having side walls which are parallel to the flow of fiber through the machine and end walls to define an enclosed bottom region in the machine beneath the carding components, comprising:

a. a first means attached to the machine to provide a flow of cleared air under positive pressure into the bottom region;

b. a pressure plenum mounted along a first side wall of the chassis, said pressure plenum connected in communication with said first means to receive the flow of air under positive pressure and having an emitting orifice extending from end wall to end wall to emit the pressurized air into the bottom region;

c. a second means mounted to the machine to draw under negative pressure a flow of air entraining waste and trash from the bottom region;

d. a suction plenum connected to said second means, mounted within the chassis to extend along the length of the opposite side wall, having a receiving orifice formed spaced from and opposite the emitting orifice through which is drawn a flow from the emitting orifice after the flow has crossed the floor and entrained waste and trash, having a triangular cross section and including a pair of triangular side plates of similar profile for use as right and left plenum sides, a vertical panel of planar rectangular configuration which is attached to said side plates, a horizontal panel of planar rectangular configuration which is attached to the bottom edges of said side plates and an inclined panel of planar rectangular configuration which is attached to said side plates to contact along one panel edge with the vertical panel and define the receiving orifice to extend from end wall to end wall between its opposite panel edge and the horizontal panel;

e. a waste concentrating means mounted to receive a flow from said suction plenum and separate this flow between a large volumetric flow of air clear of entrained waste and trash and a small volumetric flow of air in which the waste and trash is concentrated; and f. a recirculating means delivering a part of the large-portion of air to said first means so that this air is recirculated as a component of the flow provided by said first means.

19. An apparatus for removing waste and trash from a carding machine including a supporting chassis set upon a carding room floor, the chassis having side walls which are parallel to the flow of fiber through the machine and end walls to define an enclosed bottom region in the machine beneath the carding components, comprising:

a. a first means attached to the machine to provide a flow of cleared air under positive pressure into the bottom region;

b. a pressure plenum mounted to the machine, said pressure plenum connected in communication with said first means to receive the flow of air under positive pressure and having an emitting orifice to emit the pressurized air into the bottom region;

c. a second means mounted to the machine to draw under negative pressure a flow of air entraining waste and trash from the bottom region;

d. a suction plenum connected to said second means, mounted to the machine and having a receiving orifice formed spaced from and opposite the emitting orifice through which is drawn a flow from the emitting orifice after the flow has crossed the floor and entrained waste and trash;

e. a waste concentrating means mounted to receive a flow from said suction plenum and separate this flow between a large volumetric flow of air clear of entrained waste and trash and a small volumetric flow of air in which the waste and trash is concentrated, said waste concentrating means includes a conical condenser having a cylindrical housing having an inlet at one end for admitting the flow from said suction plenum, a first outlet at its opposite end for discharging the large volumetric flow and a second outlet to discharge the small volumetric flow, positioned intermediate the inlet and the first outlet, and substantially reduced in cross-sectional area as compared to the inlet; the inlet and the second outlet being interconnected by a gradually tapering foraminous frustoconical wall; and f. a recirculating means delivering a part of the large portion of air to said first means so that this air is recirculated as a component of the flow provided by said first means.

20. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first means attached to the machine to provide a flow of cleared air under positive pressure into the bottom region;

b. a pressure plenum mounted along first side of the chassis, said pressure plenum connected in communication with said first means to receive the flow of air under positive pressure and having an emitting orifice to emit the pressurized air into the bottom region;

c. a second means attached to the machine to draw under negative pressure a flow of air containing entrained waste and trash from the bottom region;

d. a suction plenum connected to said second means, mounted to the chassis along the side opposite to said first side wall and having a receiving orifice formed spaced from and opposite the emitting orifice through which is drawn a flow from the emitting orifice after the flow has crossed the floor and entrained waste and trash; and e. a waste concentrating means mounted to receive a flow from said suction plenum and separate this flow between a large volumetric flow of air clear of entrained waste and trash and a small volumetric flow of air in which the waste and trash is concentrated, said waste concentrating means includes a conical condenser having a cylindrical housing having an inlet at one end for admitting the flow from said suction plenum, a first outlet at its opposite end for discharging the large volumetric flow and a second outlet to discharge the small volumetric flow, positioned intermediate the inlet and first outlet, and substantially reduced in cross-sectional area as compared to the inlet, the inlet and the second outlet being interconnected by a gradually tapering foraminous frusto-conical wall.

21. An apparatus for removing waste and trash from a carding machine including a supporting chassis set upon a carding room floor, the chassis having side walls which are parallel to the flow of fiber through the machine and end walls to define an enclosed bottom region in the machine beneath the carding components, comprising:

a. a first means attached to the machine to provide a flow of cleared air under positive pressure into the bottom region;

b. a pressure plenum is mounted along a first side wall of the chassis, said pressure plenum connected in communication with said first means to receive the flow of air under positive pressure and having an emitting orifice to emit the pressurized air into the bottom region;

c. a second means mounted to the machine to draw under negative pressure a flow of air entraining waste and trash from the bottom region;

d. a suction plenum connected to said second means, mounted along the opposite side wall of the chassis and having a receiving orifice formed spaced from and opposite the emitting orifice through which is drawn a flow from the emitting orifice after the flow has crossed the floor and entrained waste and trash;

e. a waste concentrating means mounted to receive a flow from said suction plenum and separate this flow between a large volumetric flow of air clear of entrained waste and trash and a small volumetric flow of air in which the waste and trash is concentrated; and f. a recirculating means delivering a part of the large portion of air to said first means so that this air is recirculated as a component of the flow provided by said first means.

22. The apparatus of claim 21 wherein the emitting orifice extends from end wall to end wall and the receiving orifice extends from end wall to end wall.

23. An apparatus for removing waste and trash from a carding machine including a supporting chassis set upon a carding room floor, the chassis having side walls which are parallel to the flow of fiber through the machine and end walls to define an enclosed bottom region in the machine beneath carding components, comprising:

a. a first means attached to the machine to provide a flow of cleared air under positive pressure into the bottom region;

b. a pressure plenum mounted along a first side wall of the chassis, said pressure plenum connected in communication with said first means to receive the flow of air under positive pressure and having an emitting orifice extending from end wall to end wall to emit the pressurized air into the bottom region;

c. a second means attached to the machine to draw under negative pressure a flow of air containing entrained waste and trash from the bottom region;

d. a suction plenum connected to said second means, mounted to the chassis along the side opposite to said first side wall and having a receiving orifice extending from end wall to end wall and formed spaced from and opposite the emitting orifice through which is drawn a flow from the emitting orifice after the flow has crossed the floor and entrained waste and trash; and e. a waste concentrating means mounted to receive a flow from said suction plenum and separate this flow between a large volumetric flow of air clear of entrained waste and trash and a small volumetric flow of air in which the waste and trash is concentrated.

* * * * *